US005150914A

United States Patent [19]

Gorza

[11] Patent Number: 5,150,914

[45] Date of Patent: Sep. 29, 1992

[54] FASTENING PARTICULARLY FOR SKIS

[75] Inventor: Roberto Gorza, Feltre, Italy

[73] Assignee: Nordica S.p.A., Montebelluna, Italy

[21] Appl. No.: 650,357

[22] Filed: Feb. 4, 1991

[30] Foreign Application Priority Data

Feb. 6, 1990 [IT] Italy ..... 82518 A/90

[51] Int. Cl.[5] ..... A63C 9/08

[52] U.S. Cl. ..... 280/616; 280/628; 280/633; 280/634

[58] Field of Search ..... 280/616, 617, 618, 633, 280/634, 636, 628, 626

[56] References Cited

U.S. PATENT DOCUMENTS 4,522,422 6/1985 Jaeger ..... 280/617
4,773,669 9/1988 Peyre ..... 280/632
5,056,808 10/1991 Holzl et al. ..... 280/617

FOREIGN PATENT DOCUMENTS 371349 6/1983 Austria .
2246668 4/1974 Fed. Rep. of Germany ..... 280/617
2635686 2/1978 Fed. Rep. of Germany ..... 280/617
2151666 4/1973 France .
2344305 10/1977 France .

*Primary Examiner*—David M. Mitchell
*Attorney, Agent, or Firm*—Guido Modiano; Albert Josif

[57] ABSTRACT

The ski fastening includes a pivoting toe locking element which provides a first toe holding down locking force by means of a first spring and a rear heel locking element which provides a second heel holding down locking force by means of a second spring. Both the first spring and the second spring are housed in the heel holding device and both the locking forces provided by such springs are simultaneously adjustable upon the activation of a single screw element also provided on the heel holding device. The heel holding device furthermore includes a first body connectable to a ski in an adjustable position and a second body which is slidably supported by the first body in a direction parallel to the longitudinal extension of the ski to thereby maintain a constant distance between the heel holding device and the toe holding device of the fastening even during flexing of the ski during use.

15 Claims, 3 Drawing Sheets

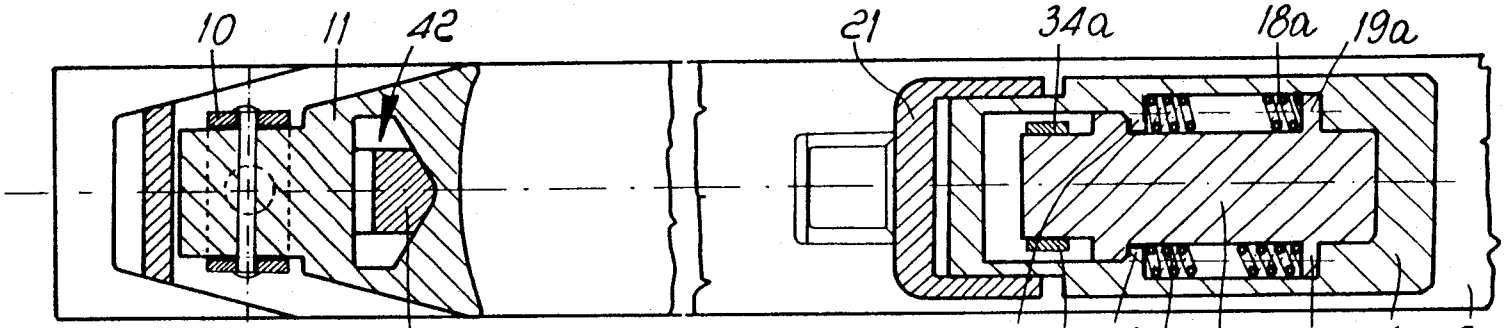
FIG. 4
FIG. 3
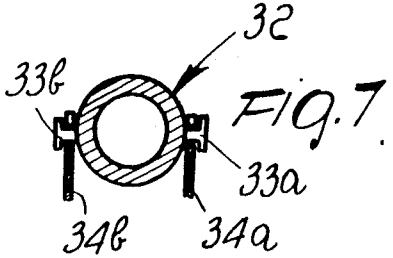
FIG. 7
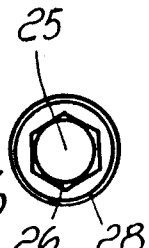
FIG. 6
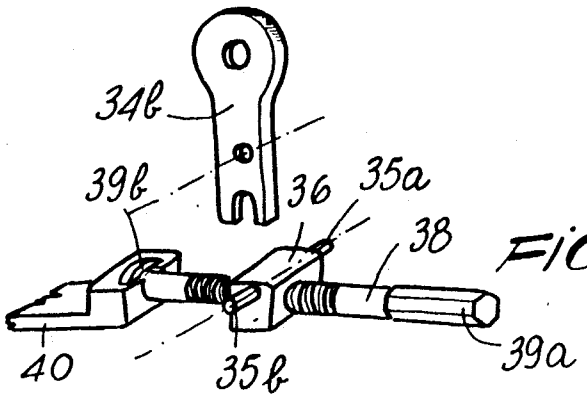
FIG. 5

FASTENING PARTICULARLY FOR SKIS

BACKGROUND OF THE INVENTION

The present invention relates to a fastening particularly usable in skis.

The known ski fastenings are constituted by a heel element and by a tip element, both associated with the ski, in order to allow the engagement of the usually standardized ends of a ski boot.

Said heel element and said tip element therefore have adapted and separate adjustment means for the correct engagement, disengagement and securing of the boot.

This solution, however, forces the skier to perform separate operations in order to optimally adjust the heel element and the tip element.

As a partial solution to this disadvantage, an Austrian patent Application No. 2622/81, filed on Jun. 12, 1981, discloses a fastening which comprises a front engagement element and a rear engagement element as well as adjustment means interposed therebetween.

Even this solution, however, has disadvantages: first of all said adjustment means are subjected to considerable stress, which leads to their rapid wear; secondly, said adjustment means, instead of varying the degree of securing of the tip element and of the heel element at the end of the boot, substantially allow to adjust the distance between the heel element and the tip element according to the size of the boot.

Finally, it should be noted that the stiff elements, such as rods, used for connecting the adjustment means with the supports for the heel element and the tip element, stiffen the ski and limit its flexibility.

SUMMARY OF THE INVENTION

The aim of the present invention is therefore to eliminate the disadvantages described above in known types by providing a fastening which allows the skier to simultaneously achieve, with a single operation, an optimum adjustment of both the front and rear engagement means.

Within the scope of the above described aim, an important object is to provide a ski fastening having components whereof are not subjected to heavy stresses during the adjustments made thereto.

Another important object is to provide a ski fastening which allows to maintain the relative distance between the front and rear engagement means during the inflections to which the ski is subjected during its use.

Not least object is to provide a ski fastening which is reliable and safe in use.

This aim, these objects and others which will become apparent hereinafter are achieved by a fastening, particularly for skis, which includes a front engagement means for engaging a ski boot toe portion and a rear engagement means for engaging a ski boot heel portion, said front and rear engagement means both being mountable on a ski top portion which defines a separated distance therebetween, said rear engagement means comprising a pivoting heel locking element and a first adjustable biasing means for providing a first adjustable locking force acting on said pivoting heel locking element, said front engagement means comprising a pivoting tip locking element and a second adjustable biasing means for providing a second adjustable locking force acting on said pivoting tip locking element, said first adjustable biasing means comprising a first spring means and said second adjustable biasing means comprising a second spring means, wherein said rear engagement means comprises means for housing both of said first spring means and said second spring means, and wherein the fastening further comprises means for simultaneously adjusting both said first and second adjustable locking forces. Advantageously, the means for housing both of said first spring means and said second spring means comprises a first body connectable at an adjustable position to the ski and a second body which is slidably supported with respect to the first body against the action of spring biasing means along a direction which parallel to the longitudinal direction of the ski to thereby maintain a constant distance between the front and rear engagement means even upon flexing of the ski.

BRIEF DESCRIPTION OF THE DRAWINGS

Further characteristics and advantages of the invention will become apparent from the detailed description of two particular but not exclusive embodiments, illustrated only by way of non-limitative example in the accompanying drawings, wherein:

FIG. 3 is a view taken along a sectional plane III—III of FIG. 1;

FIG. 4 is a view taken along the sectional plane IV—IV of FIG. 2;

FIG. 5 is an exploded view of some of the components of the rear engagement means;

FIGS. 6 and 7 are views of other details present at the rear engagement means;

DESCRIPTION OF THE PREFERRED EMBODIMENTS

Figure 1:
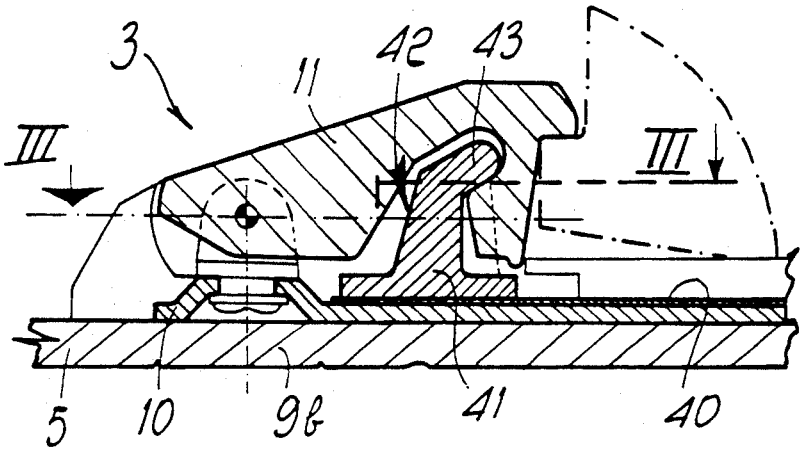
FIG. 1 is a sectional view of the front engagement means, taken along a longitudinal median axis.
Figure 2:
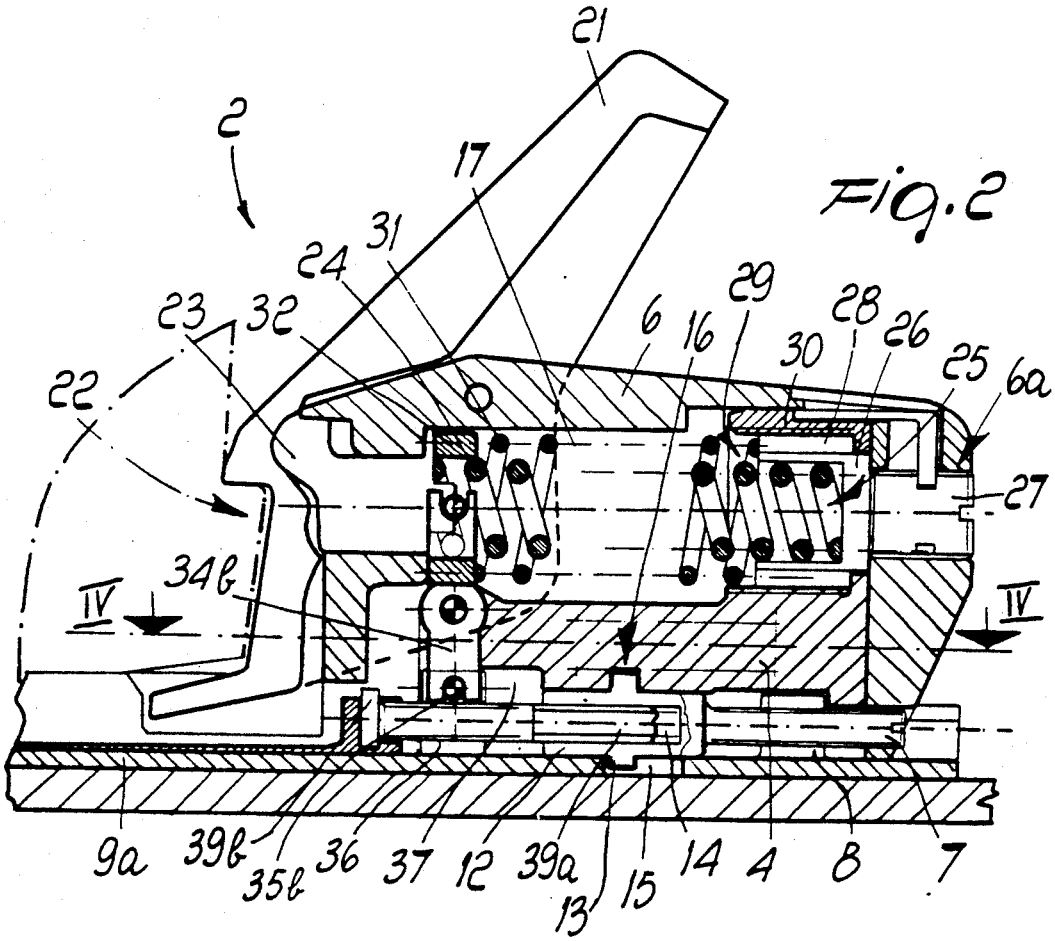
FIG. 2 is a view, similar to the preceding one, of the rear engagement means.

With reference to the above figures, the ski fastening, according to the present invention, comprises a rear engagement means 2 and a front engagement means 3.

The rear engagement means 2 is constituted by a first body 4 which is associated with a ski 5 and by a second body 6 which is slidable with respect to the first body 4.

The rear engagement means can be made to slide with respect to the ski 5, for example in order to adjust the interspace between the rear engagement means and the front engagement means; during said sliding, the first body 4 and the second body 6 rigidly move together, relatively to the ski 5.

This sliding is allowed by a first screw 7 having a stem which interacts with a complementarily threaded support 8. The support 8 is rigidly coupled to, and protrudes from, a rear plate **9*a*, which is rigidly associated with the ski 5. A front plate 9*b* is frontally provided on the same axis as the plate 9*a* and is also rigidly associated with the ski 5. A U-shaped profiled element 10 is pivoted thereto centrally to the base, and a tip element 11, which constitutes the front engagement means 3, is pivoted between the wings of said U-shaped profiled element 10 along an axis which is transverse to the ski 5**.

The first screw 7 has an end which can be accessed from the outside of the rear engagement means 2 in order to activate it by means of adapted tools such as for example a screwdriver; its other end, indicated by the numeral 12, has a perimetric tang 13 and a first axial seat with a polygonal shape, indicated by the numeral 14.

On one side, the perimetric tang 13 slides axially to the ski within an adapted second seat 15 which is defined longitudinally at the rear plate 9*a*; at the other side it is coupled to the first body 4 at a first groove 16 which is defined thereon.

The first body 4 is accommodated within a first cavity 17 internally provided in the second body 6.

The sliding of the second body 6 with respect to the first body 4, and therefore with respect to the ski, occurs in contrast with a pair of first springs 18*a* and 18*b* which are interposed between a pair of first tabs 19*a* and 19*b* which protrude laterally to the first body 4 and a pair of second tabs 20*a* and 20*b* which face the preceding ones and protrude internally to the second body 6 toward the adjacent first body 4.

The rear engagement means furthermore comprises a lever 21 which is pivoted transversely proximate to the end of the second body 6 which faces the front engagement means 3; said lever comprises at its lower end a heel locking element for releasably engaging and holding down the heel 22 of a ski boot.

A cam 23 furthermore protrudes axially at the end of the second body 6 to which the lever 21 is pivoted, and interacts with the lever 21 in contrast with a first elastically deformable element constituted by a first spring 24.

Said spring has an end which interacts with the corresponding end of the cam 23 and which is internal to the first cavity 17 of the second body 6; the other end of the spring 24 is accommodated within a third cylindrical seat 25 which is defined axially to a polygonal element 26 which is associated with the end of a second screw 27 which can be accessed from the outside of the second body 6 and which engages therewith at a threaded seat 6*a* defined thereon.

As will become clear hereinafter, the second screw 27 forms part of the means for simultaneously adjusting both of the locking forces for holding down the ski boot provided by the front and rear engagement means.

A first cylinder 28 is associated externally and coaxially to the polygonal element 26, is internally shaped complementarily to said polygonal element and is externally threaded so as to engage a complementarily shaped thread defined at a fourth cylindrical seat 29 which is defined axially to the first body 4 at a third tab 30 which protrudes therefrom from the end adjacent to the support 8.

The end of a second elastically deformable element, such as a second spring 31, is accommodated within the fourth seat 29 and abuts at the end of the first cylinder 28.

Said second spring 31 is arranged coaxially and externally to the first spring 24 and interacts with the surface of a second cylinder 32 which is arranged adjacent and coaxial to the end of the cam 23 which is internal to the first cavity 17.

First pins, indicated by the numerals 33*a* and 33*b*, protrude diametrically to the second cylinder 32 along a plane which is transverse to the ski 5.

The end of a first pair of rockers 34*a* and 34*b* is connected to the first pins; said rockers are preferably centrally pivoted transversely to the first body 4 and are connected, at their other end, to a pair of second pins 35*a* and 35*b*.

Said second pins protrude longitudinally to a block 36 which is arranged transversely and below the first body 4 at an adapted second cavity 37 defined thereon.

An internally threaded seat for a complementarily threaded third screw 38 is defined transversely to the block 36; one of the ends of said screw, which are indicated by the numerals 39*a* and 39*b*, is shaped complementarily to, and accommodated at, the first seat 14 defined at the end of the first screw 7, and the other one is mushroom-shaped.

The mushroom-shaped end 39*b* is associated in a complementarily shaped seat defined at the end of a rod 40 which is slidable above the front plate 9*b* and the rear plate 9*a*.

The rod 40 extends on said plates until it is proximate to the profile 10; a third pin 41 protrudes thereat and is accommodated in a third cavity 42 provided on the tip element 11.

The third pin 41 has a fourth tab 43 which is at an angle with respect to the plane of arrangement of the ski so as to form an acute angle in the direction of the tip of said ski, which assumes, in the region directed toward the rear engagement means, a triangular configuration with a rounded vertex.

The third cavity 42 assumes a similar configuration at the fourth tab 43.

The use of the ski fastening is as follows: initially, in order to adjust the release load, a rotation is imparted to the second screw 27 by means of adapted tools.

Said screw 27 compresses the first spring 24 and the first cylinder 28 is simultaneously moved, by virtue of the coupling between the polygonal element 26 and said first cylinder 28, concordantly with the movement of the screw 27, which compresses the second spring 31.

The pitches of the threads of the second screw 27 and of the cylinder 28 may be identical or different from one another; in the latter case, part of the ratio occurring between the first spring 24 and the second spring 31 can be obtained by varying the pitches of the two threads.

The action of the first spring 24 contrasts the rotation of the lever 21 by means of the cam 23 and therefore the release of the heel element.

The second spring 31 instead opposes the translatory motion of the second cylinder 32 which is imparted by the movement of the tip element in the manner described hereafter.

If the release of the tip element in limit conditions is to be achieved, the third pin 41 has the function of subjecting the rod 40 to traction and of then sliding it forward with respect to the ski consequent to a rotation of the tip element 11 on the vertical plane or on the horizontal plane.

The translatory motion of the rod 40 and consequently of the third screw 38 with respect to the first screw 7 moves forward the block 36 and thus the pair of second pins 35*a* and 35*b*, thereby rotating the rockers 34*a* and 34*b* around the axis of pivoting to the first body 4.

The end of the rockers which engage the first pins 33*a* and 33*b* therefore oscillates backward, moving the second cylinder 32 to compress the second spring 31.

Once the reaction or locking force provided by the spring, which is equal to the set limit load, is overcome, the tip element will rotate to thereby release the boot.

If the fastening is to be adapted to the length of the sole, a rotation imparted to the first screw 7 is followed by the backward movement of the assembly of elements formed by the first body 4 and by the second body 6 with respect to the tip element 11.

The motion transmitted to the third screw 38 ensures the backward motion of the block 36 with respect to said third screw and therefore of the second pins 35*a* and 35*b* in order to ensure the vertical alignment of the first pins 33*a* and 33*b* with the second pins 35*a* and 35*b* so as to maintain the neutral position for the rockers 34*a* and 34*b*.

It is finally possible to maintain the relative distance between the rear and front engagement means during the inflection of the ski in use by virtue of the sliding of the second body 6 with respect to the first body 4 in contrast with the first springs 18*a* and 18*b*.

The relative mutual translatory motion is also imparted between the second screw 27 and the first cylinder 28 by virtue of their mutual polygonal coupling.

This allows to keep unchanged the degree of compression of the first and second springs: the first spring 24 is fact moves rigidly with the second body 6 and with the second screw 27, whereas the second spring 31 remains in fixed position with respect to the first body 4, the first cylinder 28 and the second cylinder 32.

It has thus been observed that the invention has achieved the intended aim and objects, a fastening having been provided which has adjustments which are centralized in a single seat and which can both be actuated simultaneously by means of a single operation.

Adjustments of the locking forces provided by the two engagement means are thus achieved in which there is the assurance that the degree of setting selected for the two engagement means is the same or less than the ratio between the elastic constants of the springs.

Said ratio is, according to the currently applicable laws, constant with good approximation.

This allows, by accommodating the first spring 24 and the second spring 31, which meet the above mentioned requirement, within the first cavity 17, to compress both of them by means of the first screw 27.

It is therefore possible to perform a single manual operation for the simultaneous adjustment of the front and rear engagement means, said adjustments being adequate to the load requirements of said means, thus complying with the currently applicable laws.

Furthermore there is the assurance that the setting selected for the engagement means is the same or less than the ratio between the first spring and the second spring.

Finally, the fastening also has small dimentions.

The invention is naturally susceptible to numerous modifications and variations, all of which are within the scope of the same inventive concept.

Figure 8:
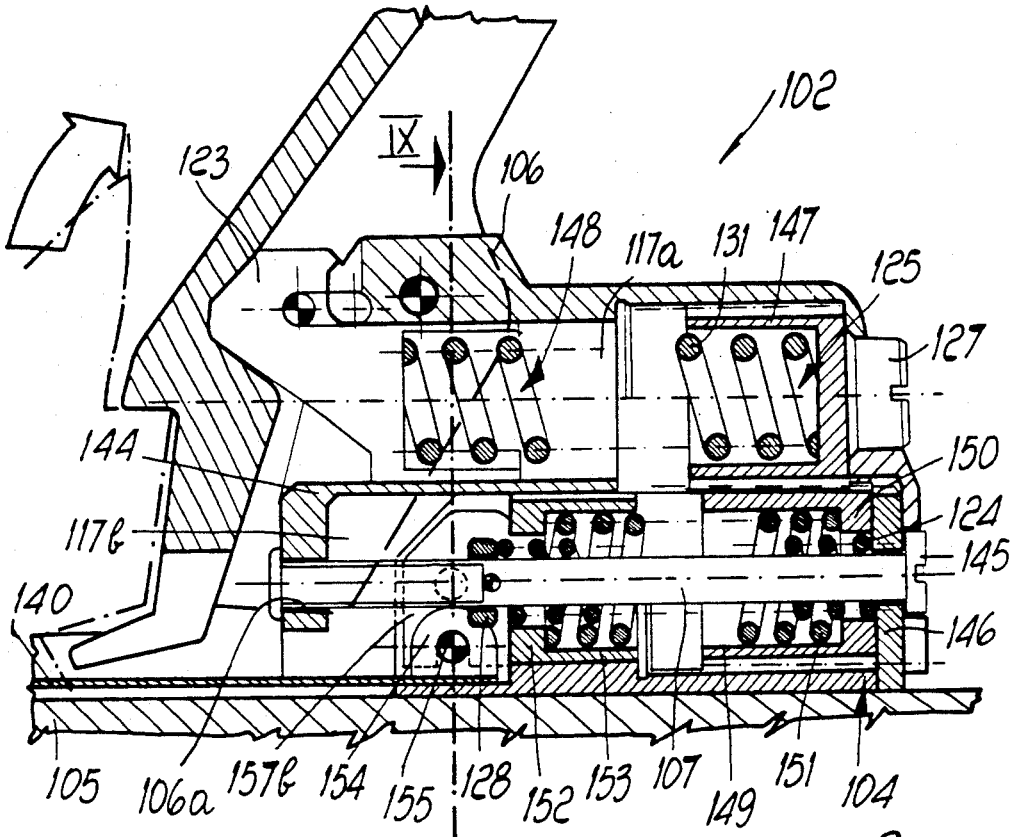
FIG. 8 is a view, similar to that of FIG. 2, of a second embodiment for the rear engagement means.
Figure 9:
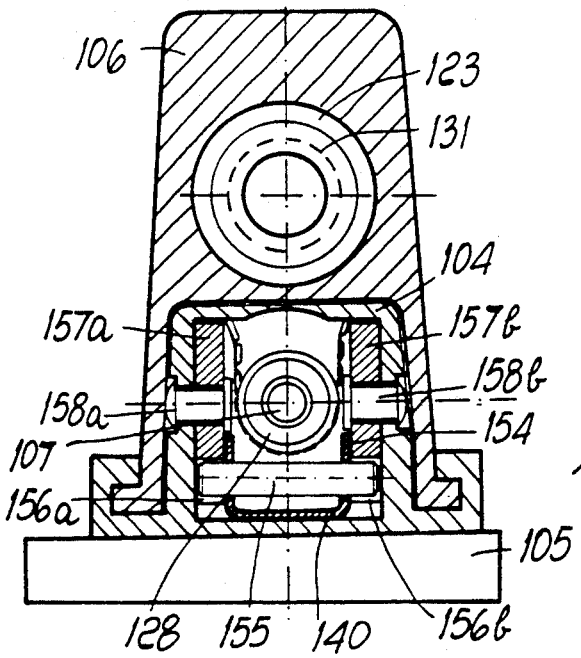
FIG. 9 is a view taken along the sectional plane IX—IX of FIG. 8.

FIGS. 8 and 9 illustrate a second embodiment for a ski fastening in which specifically the rear engagement means 102 is again composed of a first body 104 which is fixed with respect to the ski 105 and by a second body 106 which is slidable with respect to the first body.

The second body 106 again has a box-like structure inside which a pair of first cavities 117*a* and 117*b* is defined; said cavities are partially mutually divided by a partition 144 which is arranged approximately parallel to the plane of the ski 105 and is slightly higher than the first body 104 so as to be able to contain said body.

A first screw 107 is arranged longitudinally to the ski at the first lower cavity 117*b* and has a head 145 which protrudes rearward to both the first body 104 and the second body 106; the other end is threaded and engages at a complementarily threaded seat 106*a* defined on the second body 106.

The rotation of the first screw 107 therefore allows to adapt the fastening to the length of the sole since a translatory motion of the second body 106 with respect to the ski 105 is forced.

A first spring 124 is arranged coaxially to the stem of the first screw 107 and abuts at one end with the rear wall 146 of the first body 104 and, at the other end, with a first cylinder 128 which is keyed to the first screw 107.

The purpose of the first spring 124 is to contrast the sliding of the second body 106 with respect to the first body 104 during the inflection of the ski, to recover the elastic plays.

The release load is adjusted by means of a second screw 127 which is rotatably associated with, and rearwardly protrudes from, the second body 106 and has a cylindrical stem 147 on the outer surface whereof a threaded set of teeth is defined and interacts with a complementary thread defined at the facing surface of the second body 106.

The cylindrical stem 147 is internally partially hollow so as to define a third seat 125 for a second spring 131 which is accommodated at the other end within an adapted fifth seat 148 defined on the end of the cam 123 which protrudes internally to the first cavity 117*a*.

The cylindrical stem 147 of the second screw 127 meshes, upon a rotation imparted thereto, with a complementary threaded set of teeth defined on the outer surface of a third cylinder 149 which is arranged coaxially to the first screw 107 and has a first base 150, adjacent to the head 145, which abuts at the end of a third spring 151 which is arranged coaxially and externally to the first spring 124.

Said third spring 151 abuts, at the other end, with a second base 152 of a fourth cylinder 153 which has an axial through hole for the first screw 107 and for the first spring 124.

The ski fastening furthermore comprises a rod 140 which has, at the end of the first body 104 which is adjacent to the cam 123, a pair of shoulders 154 between which a first pin 155 is interposed.

The depressions 156*a* and 156*b*, defined at the lower end of a pair of second cams 157*a* and 157*b* which are freely pivoted laterally to the body 104 by means of second pins 158*a* and 158*b*, are positioned on the ends of said pin 155 which protrude beyond the pair of shoulders 154.

As regards the release of the tip element in limit conditions, the forward sliding of the rod 140 imparts a rotation to the second cams 157*a* and 157*b*, which compress the third spring 151 through the sliding imparted to the fourth cylinder 153.

Therefore, for a load equal to the limit value, the release of the boot from the tip element is allowed.

Therefore, this second embodiment, too, achieves the previously mentioned aim and objects.

The materials and dimensions which constitute the individual elements of the safety fastening may naturally be the most appropriate according to the specific requirements.

I claim:

1. A fastening, particularly for skis, comprising a front engagement means for engaging a ski boot toe portion and a rear engagement means for engaging a ski boot heel portion, said front and rear engagement means both being mountable on a ski top portion which defines a separated distance therebetween, said rear engagement means comprising a pivoting heel locking element and a first adjustable biasing means for providing a first adjustable locking force acting on said pivoting heel locking element, said front engagement means comprising a pivoting tip locking element and a second adjustable biasing means for providing a second adjustable locking force acting on said pivoting tip locking element, said first adjustable biasing means comprising a first spring means and said second adjustable biasing means comprising a second spring means, wherein said rear engagement means comprises means for housing both of said first spring means and said second spring means, and wherein the rear engagement means further comprises means for simultaneously adjusting both said first and second adjustable locking forces.

2. The fastening according to claim 1, wherein said first spring means is constituted by a first spring (131) and said second spring means is constituted by a second spring (151), said first adjustable biasing means further comprising a cam element (123) which is biasable into locking engagement with said pivoting heel locking element by said first spring, said second adjustable biasing means further comprising a pin element (41) which is biasable into locking engagement with said tip locking element by said second spring, said means for simultaneously adjusting both said first and second adjustable locking forces comprising:

a screw (127) which is rotatably mounted on said means for housing and which is provided with an externally threaded cylindrical stem (147) which internally accommodates an end of said first spring (131); and an externally threaded cylinder (149) which is slidably supported by said means for housing, which is in threaded engagement with said externally threaded cylindrical stem (147), and which internally accommodates an end of said second spring (151), thereby a rotation of said screw (127) simultaneously provides translatory motion to both said cylindrical stem (147) and said cylinder (149) to adjust both said first and second locking forces provided by said first and second springs.

3. The fastening according to claim 2, wherein said means for housing comprise a first body (104) which is rigidly connectable to a ski, and a second body (106) which is slidably supported by said first body in a direction parallel to a longitudinal extension of the ski, said second body being biased into a forward position by a third spring means (124).

4. The fastening according to claim 3, wherein said forward position of said second body with respect to said first body is adjustable by means of a second screw (107) which is rotatably supported by said first body and which threadingly engages with a treaded portion (106*a*) of said second body, said third spring means being constituted by a third spring (124) which encircles said second screw and which is interposed between a cylinder element (128) connected to said second screw and a rear wall (146) of said first body (104).

5. The fastening according to claim 2, wherein said second adjustable biasing means further comprise:

a hollow cylindrical element (153) which has a base (153), which internally accommodates another end of said second spring (151), and which is slidably supported by said means for housing;

a pair of pivoting cams (157*a*,157*b*) rigidly connected at upper ends thereof to said base (153) of said cylindrical element (153);

a pin (155) connected to lower ends of said pivoting cams; and a rod element (40) which is rigidly connected at one end thereof to said pin element (41) and which is connected to said pin (155) at another end thereof by means of a pair of shoulders (154) rigidly connected therewith.

6. The fastening according to claim 1, wherein said means for housing comprise a first body (104) which is rigidly connectable to a ski, and a second body (106) which is slidably supported by said first body in a direction parallel to a longitudinal extension of the ski, said second body being biased into a forward position by a third spring means (124), said first spring means being constituted by a first spring (131) accommodated in a cavity (117*a*) of said second body (106) and said second spring means being constituted by a second spring (151) accommodated in a cavity (117*b*) of said first body (104), said first adjustable biasing means further comprising a cam element (123) which is biasable into locking engagement with said pivoting heel locking element by said first spring, said second adjustable biasing means further comprising a pin element (41) which is biasable into locking engagement with said tip locking element by said second spring, said means for simultaneously adjusting both said first and second adjustable locking forces comprising:

a screw (127) which is rotatably mounted on said second body and which is provided with an externally threaded cylindrical stem (147) which internally accommodates an end of said first spring (131); and an externally threaded cylinder (149) which is slidably supported by said first body, which is in threaded engagement with said externally threaded cylindrical stem (147), and which internally accommodates an end of said second spring (151), thereby a rotation of said screw (127) simultaneously provides translatory motion to both said cylindrical stem (147) and said cylinder (149) to adjust both said first and second locking forces provided by said first and second springs, said second adjustable biasing means further comprising:

a hollow cylindrical element (153) which has a base (153), which internally accommodates another end of said second spring (151), and which is slidably supported by said first body (104);

a pair of pivoting cams (157*a*,157*b*) rigidly connected at upper ends thereof to said base (153) of said cylindrical element (153);

a pin (155) connected to lower ends of said pivoting cams; and a rod element (40) which is rigidly connected at one end thereof to said pin element (41) and which is connected to said pin (155) at another end thereof by means of a pair of shoulders (154) rigidly connected therewith.

7. The fastening according to claim 6, wherein said forward position of said second body with respect to said first body is adjustable by means of a second screw (107) which is rotatably supported by said first body, which extends through said cavity (117*b*) of said first body, and which threadingly engages with a treaded portion (106*a*) of said second body, said third spring means being constituted by a third spring (124) which encircles said second screw internally of said second spring (151) and which is interposed between a cylinder element (128) connected to said second screw and a rear wall (146) of said first body (104).

8. The fastening according to claim 1, wherein said first spring means is constituted by a first spring (24) and said second spring means is constituted by a second spring (31), said first adjustable biasing means further comprising a cam element (23) which is biasable into locking engagement with said pivoting heel locking element by said first spring, said second adjustable biasing means further comprising a pin element (41) which is biasable into locking engagement with said tip locking element by said second spring, said means for simultaneously adjusting both said first and second adjustable locking forces comprising:

a screw (27) which is rotatably mounted on said means for housing and which is provided with an internally hollow polygonal element (26) which internally accommodates an end of said first spring (24);

an externally threaded cylinder (28) which is internally hollow with a polygonal shape, which is supported by said polygonal element (26), and which abuts with an end of said second spring (31); and an internal thread (30) which is provided on said means for housing and which is in threaded engagement with said externally threaded cylinder (28), thereby a rotation of said screw (27) simultaneously provides translatory motion to both said polygonal element (26) and said cylinder (28) to adjust both said first and second locking forces provided by said first and second springs.

9. The fastening according to claim 8, wherein said means for housing comprise a first body (4) which is connectable to a ski, and a second body (6) which is slidably supported by said first body in a direction parallel to a longitudinal extension of the ski, said second body being biased into a forward position by a third spring means (18*a*,18*b*).

10. The fastening according to claim 9, wherein said third spring means are constituted by a pair of third springs (18*a*,18*b*) interposed between a pair of lateral outwardly protruding tabs (19*a*,19*b*) of said first body (4) and a pair of lateral inwardly protruding tabs (20*a*,20*b*) of said second body (6).

11. The fastening according to claim 8, wherein said second adjustable biasing means further comprise:

a hollow cylindrical element (32) which abuts against another end of said second spring (31);

a pair of rocker elements (34*a*,34*b*) which are pivoted transversely at upper ends thereof to said cylindrical element (32) by means of a pair of first protruding pins (33*a*,33*b*) and which are pivoted at middle portions thereof to said means for housing;

a rod element (40) which is rigidly connected at one end thereof to said pin element (41) and which is connected to a block (36) at another end thereof; and a pair of second pins (35*a*,35*b*) which are rigidly connected with said block (36) and to which are pivoted respective lower ends of said pair of rocker elements (34*a*,34*b*).

12. The fastening according to claim 1, wherein said means for housing comprise a first body (4) which is connectable to a ski, and a second body (6) which is slidably supported by said first body in a direction parallel to a longitudinal extension of the ski, said second body being biased into a forward position by a third spring means (18*a*,18*b*), said first spring means being constituted by a first spring (24) and said second spring means being constituted by a second spring (31) both of which are accommodated in a cavity (17) of said second body (6), said first adjustable biasing means further comprising a cam element (23) which is biasable into locking engagement with said pivoting heel locking element by said first spring, said second adjustable biasing means further comprising a pin element (41) which is biasable into locking engagement with said tip locking element by said second spring, said means for simultaneously adjusting both said first and second adjustable locking forces comprising:

a screw (27) which is rotatably mounted on said second body (6) and which is provided with an internally hollow polygonal element (26) which internally accommodates an end of said first spring (24);

an externally threaded cylinder (28) which is internally hollow with a polygonal shape, which is supported by said polygonal element (26), and which abuts with an end of said second spring (31); and an internal thread (30) which is provided on said first body (4) and which is in threaded engagement with said externally threaded cylinder (28), thereby a rotation of said screw (27) simultaneously provides translatory motion to both said polygonal element (26) and said cylinder (28) to adjust both said first and second locking forces provided by said first and second springs, said second adjustable biasing means further comprising:

a hollow cylindrical element (32) which abuts against another end of said second spring (31);

a pair of rocker elements (34*a*,34*b*) which are pivoted transversely at upper ends thereof to said cylindrical element (32) by means of a pair of first protruding pins (33*a*,33*b*) and which are pivoted at middle portions thereof to said first body (4);

a rod element (40) which is rigidly connected at one end thereof to said pin element (41) and which is connected to a block (36) at another end thereof; and a pair of second pins (35*a*,35*b*) which are rigidly connected with said block (36) and to which are pivoted respective lower ends of said pair of rocker elements (34*a*,34*b*).

13. The fastening according to claim 12, wherein said third spring means are constituted by a pair of third springs (18*a*,18*b*) interposed between a pair of lateral outwardly protruding tabs (19*a*,19*b*) of said first body (4) and a pair of lateral inwardly protruding tabs (20*a*,20*b*) of said second body (6).

14. The fastening according to claim 12, further comprising means for adjustably connecting said first body (4) to the ski which comprise:

a rigid internally threaded supported (8) rigidly fixable to the ski;

a screw element (7) which threadingly engages with said threaded support (8) and which is provided with an end (12) having an internal axial polygonal seat (14) and a perimetric protruding tang (13); and a groove (16) provided in said first body (4) in which said perimetric tang (13) is slidingly accommodated, said rod element (40) being connected to said block (36) by means of a third screw (38) having:

a middle thread portion which engages with a threaded hole provided in said block (36);

a first polygonal end (39*a*) slidably accommodated in said axial polygonal seat (14); and a second mushroom shaped end (39*b*) slidably accommodated in a cylindrical shaped seat provided in said rod element (40).

15. A fastening, particularly for skis, comprising a front engagement means for engaging a ski boot toe portion and a rear engagement means for engaging a ski boot heel portion, said front and rear engagement means both being mountable on a ski top portion which defines a separated distance therebetween, said rear engagement means comprising a pivoting heel locking element and a first adjustable biasing means for providing a first adjustable locking force acting on said pivoting heel locking element, said front engagement means comprising a pivoting tip locking element and a second adjustable biasing means for providing a second adjustable locking force acting on said pivoting tip locking element, said first adjustable biasing means comprising a first spring means and said second adjustable biasing means comprising a second spring means, wherein said rear engagement means comprises means for housing both of said first spring means and said second spring means, and wherein the rear engagement means further comprises means for simultaneously adjusting both said first and second adjustable locking forces, the fastening further comprising means for adjusting said separated distance between said front and rear engagement means.

* * * * *